US010472741B2

(12) United States Patent
Zeyrek et al.

(10) Patent No.: US 10,472,741 B2
(45) Date of Patent: Nov. 12, 2019

(54) GARMENT AND PROCESS OF PREPARATION

(71) Applicant: Sanko Tekstil Isletmeleri San. Ve Tic. A.S., Inegol-Bursa (TR)

(72) Inventors: Mustafa Zeyrek, Inegol-Bursa (TR); Erdogan Baris Özden, Inegol-Bursa (TR); Fatih Konukoglu, Inegol-Bursa (TR); Mehmet Fikret Akgunlu, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 238 days.

(21) Appl. No.: 15/215,826

(22) Filed: Jul. 21, 2016

(65) Prior Publication Data

US 2017/0022637 A1 Jan. 26, 2017

(30) Foreign Application Priority Data

Jul. 22, 2015 (EP) ..... 15177938

(51) Int. Cl.

| | |
|---|---|
| ***D03D 15/08*** | (2006.01) |
| ***D02G 3/32*** | (2006.01) |
| ***D03D 15/00*** | (2006.01) |
| ***D03D 17/00*** | (2006.01) |

(52) U.S. Cl.

CPC ..... *D02G 3/32* (2013.01); *D03D 15/0061* (2013.01); *D03D 15/08* (2013.01); *D03D 17/00* (2013.01)

(58) Field of Classification Search

CPC ..... D03D 15/0061; D03D 15/08; A41D 1/06; A41D 31/18

See application file for complete search history.

(56) References Cited

U.S. PATENT DOCUMENTS

| | | | | |
|---|---|---|---|---|
| 3,452,411 A * | 7/1969 | Brown | ..... | D02G 3/328 139/421 |
| 3,504,712 A * | 4/1970 | Thompson | ..... | D06C 21/00 139/421 |
| 5,858,885 A * | 1/1999 | Hamilton | ..... | D02G 3/328 139/420 A |
| 6,800,159 B2 | 10/2004 | Itoh | | |

(Continued)

FOREIGN PATENT DOCUMENTS

| | | |
|---|---|---|
| CN | 103 556 348 A | 2/2014 |
| ES | 2 214 151 A1 | 9/2004 |

(Continued)

OTHER PUBLICATIONS

International Search Report and written opinion of corresponding PCT application No. PCT/EP2016/067542 dated Oct. 18, 2016.

(Continued)

*Primary Examiner* — Danny Worrell

(74) *Attorney, Agent, or Firm* — Silvia Salvadori

(57) ABSTRACT

A garment article is made of a fabric including a plurality of warp and weft yarns woven together in a pattern; at least the weft yarns include elastomeric yarns, to provide an elasticity of the fabric in warp direction that is at least 7% and elasticity of the fabric in weft direction that is at least 15%; the fabric of the garment is bias cut so that the weft yarns in the garment are angled with respect to the widthwise direction (WD) of the article.

12 Claims, 2 Drawing Sheets

(56) References Cited

U.S. PATENT DOCUMENTS

| | | | | |
|---|---|---|---|---|
| 7,299,828 | B2 * | 11/2007 | Liao | A41D 31/00 139/420 A |
| 7,727,286 | B2 * | 6/2010 | Reid | D04B 21/16 8/101 |
| 7,776,770 | B2 * | 8/2010 | Wang | A41B 17/00 442/306 |
| 7,841,369 | B1 * | 11/2010 | Osborne | A41D 13/0012 139/319 |
| 7,928,022 | B2 * | 4/2011 | Harding | C08F 10/00 442/182 |
| 8,093,160 | B2 * | 1/2012 | Tharpe, Jr. | D01H 1/00 442/191 |
| 2004/0229538 | A1 * | 11/2004 | Love, III | D03D 17/00 442/182 |
| 2008/0318485 | A1 * | 12/2008 | Cheng | D01H 1/02 442/182 |
| 2009/0191777 | A1 * | 7/2009 | Liao | D03D 13/004 442/184 |
| 2012/0244771 | A1 | 9/2012 | Tharpe, Jr. et al. | |
| 2013/0048140 | A1 * | 2/2013 | Yenici | D03D 15/04 139/422 |
| 2013/0260129 | A1 * | 10/2013 | Agzikara | D02G 3/324 428/221 |
| 2014/0123362 | A1 * | 5/2014 | Seitz | A41D 7/008 2/69 |
| 2015/0034205 | A1 * | 2/2015 | Yenici | D03D 1/00 139/421 |
| 2015/0133017 | A1 * | 5/2015 | Liao | D03D 15/08 442/184 |

FOREIGN PATENT DOCUMENTS

| | | |
|---|---|---|
| GB | 448829 | 6/1936 |
| JP | 200427460 | 1/2004 |
| WO | WO2008/130563 | 10/2008 |
| WO | WO2009/022883 | 2/2009 |
| WO | WO2011/104022 | 9/2011 |
| WO | WO2011/151851 A2 | 12/2011 |
| WO | WO2012/062480 | 5/2012 |
| WO | WO2013/148659 | 10/2013 |
| WO | 2014113207 | 7/2014 |
| WO | WO2015/014801 | 2/2015 |
| WO | WO2015/014895 | 2/2015 |

OTHER PUBLICATIONS

Office Action issued by the European patent office for corresponding EP application No. 15177938.6 dated Mar. 26, 2019.

Kan & Yuen:"Evaluation of the performance of stretch denim fabric under the effect of repeated homelaundering processes", International Journal of Fashion Design, Technology and Education, Nov. 6, 2009 reported by the European Patent Office on Jun. 4, 2019.

Office Action issued by the CN patent office for corresponding CN application No. 201610782192.5 dated May 24, 2019.

Cover letter of the CN local agent reporting the office action issued by the CN patent office for corresponding CN application No. 201610782192.5 dated May 24, 2019.

* cited by examiner

GARMENT AND PROCESS OF PREPARATION

RELATED APPLICATION

This application claims priority to European Application No. EP 15177938.6 filed 22 Jul. 2015, the contents of which are hereby incorporated by reference as if set forth in their entirety.

FIELD OF THE INVENTION

The present invention relates to the manufacture of a garment and to the process of the preparation of said garment. In particular the garment article of the invention is made of a fabric that is bias-cut.

BACKGROUND ART

Day by day performance is becoming very important in the textile sector, particularly but not only for garment articles such as jeans, jackets, trousers, shorts and sport garments in general. Performance means high elasticity, good recovery, shaping, good fits, strength etc. Because of this, performance of warps and wefts in woven fabrics is really important, in particular as far as elasticity and comfort are concerned.

Over the years elastic woven fabrics have become very popular with the users; a woven fabric that is also elastic can provide an appearance and a performance that is better than the appearance or performance of a knitted fabric while still being very comfortable to wear. In order to produce elastic fabrics, elastic yarns are used; elastic yarns provide both aesthetic, and elasticity functions. The most common way of producing stretch fabrics is weft-stretch fabrics. Weft-stretch fabrics have non-elastic warp yarns and elastic weft yarns. In these fabrics different kinds of elastic weft yarns such as corespun elasthane yarns, twisted elasthane yarns, etc. are used. Weft-stretch fabrics are not stretchable along the warp direction, are usually comfortable but their comfort level is not enough during long usage times, as they do not follow the movements of the body.

In order to solve this problem, several types of fabrics have been developed, for example warp-stretch fabrics, and the so called "bi-stretch" fabrics, i.e. fabrics that can be stretched both in weft and warp direction. This bidirectional stretchability, i.e. ability to be elongated, is obtained by including elastic yarns in both warp and weft direction. However, also these kinds of fabrics present drawbacks.

Warp-stretch fabrics can present grin-through of the elastomer, i.e. the exposure, in a fabric, of bare elastomeric filaments to view. In fact, according to the known state of the art it is not possible to make very high stretch fabrics in vertical side (warp direction) because of quality problems of core spun yarn in rope dye.

Bi-stretch fabrics known in the art have also several problems, such as the growth of the fabric, and little recovery after stretching.

Another problem is the poor performance of highly elastic bi-stretch fabrics: after few stretch and return cycles, the known fabrics are not able to retain the original aspect. The fabrics lose their original hand and appearance and show curling, creasing and torqueing to such a degree that the garments made with said fabrics have to be discarded after a short time.

A problem of the known bi-stretch fabrics, for example denim fabrics, is that it is really difficult to obtain a fabric with the appropriate balance of physical characteristics, suitable for garments able to combine desirable visual and tactile aesthetics, with good performance in stretchability, recovery (i.e. limited growth of the fabric after having been elongated or stretched) and comfort.

For example, fabrics with a high amount of elastic yarns can have problems of loss of aesthetics, especially because of growth; on the contrary, fabrics with low values of elasticity can be uncomfortable in daily life. Additionally, prolonged usage of stretch fabrics can cause a loss in recovery power of the fabric, thus causing the growth of the fabric. Another problem of the known fabrics, for example denim fabrics, is the poor body holding, i.e. body shaping power.

Several solutions have been proposed to solve the above problems. WO2013/148659 discloses a woven fabric comprising a corespun elastic base yarn and a separate control yarn, to avoid overstretching. Control yarn is hidden inside the fabric by the adjacent elastic corespun base yarn. US 2012/0244771 discloses elastic composite yarns having a stretchable core and a sheath of spun staple fibers; the core is made of an elastic filament and an inelastic filament that is loosely wound around the elastic filament to control the stretching. The above disclosed solution provides bi-stretch fabrics that are provided with too low elasticity (i.e. stretch), namely about 10-12% warp direction and 17-20% in weft direction.

WO2008/130563 discloses elastic yarns having a core made of an inelastic fiber loosely wound around an elastic fiber.

WO 2012/062480, in the name of the present applicant Sanko Tekstil, discloses elastic composite yarns having elastic stretchable core and a sheath of inelastic staple fibers; the core is made of an elastic filament and a less elastic filament attached together by coextrusion, intermingling or twisting. The less elastic filament controls the stretch and provides recovery so as to move as a single fiber that has high elasticity and very good recovery properties.

WO2009022883 discloses a garment made from a fabric that is bias cut. The problem to be solved by this document is to provide an alternative to tight clothes made with elastic fabric containing rubber or elastic yarns. The claimed solution is to use a (non-elastic) bias-cut fabric i.e. a fabric cut in such a way that the diagonal line joining two over portions of adjacent wefts is oriented substantially horizontally.

Garments obtained from bias cut fabric are known also from e.g. GB 448829, relating to a brassiere in which the pockets 5 for the breasts are made at least in part with a fabric "cut on the bias".

U.S. Pat. No. 6,800,159 discloses a method of producing a bias-cut cloth by coupling bias-cut fabric parts that are alternatively left bias and right bias. However, the above discussed problems of recovery power, comfort in use and holding/shaping power of the fabric are still present, particularly in the final garments that are styled in the so-called skinny or super-skinny models, i.e models that require a total or almost total adherence of the garment to the body of the user.

In view of the above mentioned problems, there is a need for new garments able to combine high elasticity and good aesthetics; for example, there is a need in the market for new fabrics having an improved holding power and recovery, reduced growth, combined with good visual and tactile aesthetics. More in particular, there is a need of new garments, such as denim garments, with improved recovery, improved body holding power and that can follow any body movement.

SUMMARY OF THE INVENTION

An aim of the present invention is to solve the problems of the prior art, providing garments and in general articles that have an improved holding power, and that provide a great freedom of movement, thus avoiding the feeling of tightness and discomfort.

Another aim of the present invention is to provide a garment and in general articles that combine good performance, such as improved body holding/shaping power, improved recovery and reduced growth, with good aesthetics.

A further aim of the present invention is to provide a process for producing an article, namely a garment, as mentioned above.

These and other aims are achieved by a garment according to claim 1, that can be produced by means of a process according to claim 10.

Therefore, an object of the present invention is an article, comprising:

a fabric (1, 6) including a plurality of warp yarns (2) and a plurality of weft yarns (3) woven together in a pattern to provide over portions and under portions of weft and warp yarns, wherein the weft yarns include elastomeric yarns (3), characterized in that said elastomeric yarns have a stretchable core and a sheath of inelastic fibers that covers said core, in that the elasticity of the fabric in warp direction is at least 5%, preferably at least 7%, (measured according to ASTM D3107—Stretch, after 3 home washes) and elasticity of the fabric in weft direction is at least 15%, (ASTM D3107—stretch, after 3 home washes) and in that said fabric is bias cut, whereby the weft yarns in said article are angled ($\alpha$) with respect to the widthwise direction (WD) of said article (6).

According to an aspect of the invention, the angle $\alpha$ of the weft yarns with respect to the widthwise direction of said garment is in the range of 10° to 80°. Preferred angles are 40° to 50°, most preferably about 45°.

Preferably, all, or substantially all, weft yarns are elastic yarns.

Suitable elastic yarns for the present invention are stretch yarns; stretch yarns are known in the art, they are yarns that return to the original length (or almost to the original length, because of a possible "growth") after having been stretched. A first type of stretch yarns are those that can elongate up to 18%-25% without breaking; examples of these yarns are T400, PBT and similar yarns. A second type of suitable stretch yarns are those yarns that can stretch to 60-80% without breaking. Exemplary products are Lycra, Elastane, Lastol, Dow XLA, Spandex, PU and similar yarns. Elastic yarns may be corespun yarns. Corespun yarns may be used in warp or weft or both.

Suitable elastic corespun yarns are those disclosed in WO2008/130563 and in WO 2012/062480.

According to a preferred embodiment of the invention, the elastomeric yarns have a stretchable core comprising a first elastic fiber and a second fiber that is less elastic than said first fiber wherein said first fiber and second fiber are connected together by intermingling, twisting or coextrusion to control elongation of said first fiber. The first fiber and the second fiber are connected together as disclosed in mentioned applications, e.g. as mentioned at pages 9 and 10 of WO 2012/062480. In a preferred embodiment the first and second fibers are intermingled and the number of connecting points is within the range of 50 to 200 points per meter. In another embodiment, first and second fibers are connected by twisting and the number of twists per meter is in the range of 200 to 800 twists per meter, preferably 300 to 600 twists per meter.

Preferably, the elastic corespun yarn has an Ne count ranging from 4 Ne to 100 Ne, preferably from 10 Ne to 60 Ne, more preferably 14 Ne to 40 Ne. Suitable fabrics are exemplified in FIGS. 2 and 3, that show respectively, a 3/1 RHT weave and a twill weave. However, the invention is not limited to the above weaves, and can be used e.g. with a variety of different weave constructions, such as 2/1 twill weave, broken twill, zig-zag twill, reverse twill and others.

Other weaving constructions that may be used in the invention are disclosed e.g. in PCT/EP2014/066384, PCT/EP2014/066191, WO2011/104022, all in the name of the present applicant.

According to a preferred embodiment, the fabric has a weight ranging from 80 g/m$^2$ to 500 g/m$^2$ (according to ASTM D3776), preferably 200 g/m$^2$ to 400 g/m$^2$.

A preferred fabric for the article of the invention is a denim fabric.

In an exemplary embodiment, the fabric undergoes finishing steps but does not undergo the usual heat setting treatment for elastic yarns. Heat treatment, i.e. heat setting of the fabric is a well-known step of traditional processes of fabric preparation, used e.g. to give dimensional stability to the elastic fabric after weaving by heating the fabric to a setting temperature for the elastomers of the elastic core of the yarns. E.g., the temperature for heat setting of lycra is about 180° C. Heat treatment at lower temperatures, as in sanforization, at about 110° C. is usually carried out in the present invention's process.

According to an aspect of the invention, elasticity in the warp direction ($E_{warp}$) is at least 5% preferably at least 7%, and is preferably comprised in the range of 10% to 100%, preferably 15% to 45%, more preferably 20% to 35%, most preferably 25% to 35% (ASTM D3107 MODIFIED (Stretch) after 3 home wash). According to an exemplary aspect of the invention, elasticity in the weft direction ($E_{weft}$) is at least 15%, preferably at least 20%, more preferably at least 50%. Eweft is preferably comprised in the range of 15% to 100%, preferably 30% to 80%, more preferably 30% to 65%, most preferably 35% to 65% (ASTM D1037 MODIFIED (Stretch) after 3 home wash).

In a preferred embodiment of the invention, the core of the yarns are intermingled or twisted as per above discussion, the fabric undergoes finishing steps but does not undergo a heat setting treatment for elastic yarns.

It was surprisingly found that an elastic woven fabric according to the present invention, when bias cut, results in a dramatic improvement of the elasticity (% ASTM D3107); in particular, it was found that by using elastic weft yarns and non-elastic warp yarns, the bias cut fabric will be provided with very high levels of elasticity. The actual values of elasticity in vertical and horizontal directions were found to be very similar and substantially the same notwithstanding the fact that in the fabric the elasticity warpside was much lower than elasticity weftside.

In one aspect, the present invention provides an elastic woven fabric, which comprises elastic yarns of the core spun type both warpwise and weftwise, so that all yarns of the fabric are elastic yarns.

The invention solves the long felt need to have a fabric with comparable elasticity values in vertical and horizontal directions. Such a fabric was not previously available. Use of highly elastic warp yarns in the fabric resulted in grin-through of the elastomeric core and other problems in the fabric aspect. This is a very important advantage over prior art one-stretch and bi-stretch fabrics; the prior art fabrics could not withstand a stretching action as high as the claimed one for the invention fabric, without said known fabrics suffering visual damages in the form of undulations or torqueing of the fabric.

A further advantage is that it was observed that a garment according to the invention shows an improved holding power (or shaping power) of the body with respect to known fabrics.

Another advantage of the fabric of the present invention is that elasticity present at least in width direction (WD) and possibly also in vertical direction (VD) direction, is enhanced by the bias cut of the fabric, so that an improvement of recovery, and a reduction of the growth, is obtained in the garment.

Therefore the fabric of the invention will not be over-stretched or stressed, thus avoiding damages and lack of performance, such as lack of recovery, growth increase, and bagging.

For example, in the so called "super-skinny" garments, the garment's cut is usually smaller than the normal body size. Therefore, just wearing super skinny garments, causes the stretching of the fabric which the garments are made of. In view of this fact, a normal use can cause overstretching of the fabric of the super-skinny garment, thus causing damages to the fabric and bagging, e.g. at knees and elbows. Another problem could be a too-tight adherence of the elastic fabric to the body of the user, with possible problems in blood circulation.

The fabric of the present invention allows to avoid these problems. In particular, these problems are avoided because the fabric of the invention is able to move with human skin, i.e. is able to move as human skin does. The invention will be further disclosed with reference to the following figures that refer to exemplary and non-limiting embodiments and features of the invention.

DETAILED DESCRIPTION

The present invention relates to an article, preferably a garment, e.g. a cloth, made of a fabric including a plurality of warp yarns and a plurality of weft yarns woven together in a pattern to provide over portions and under portions of weft and warp yarns, wherein the weft yarns include elastic yarns, characterized in that said elastic yarns have a stretchable core and a sheath of inelastic fibers that covers said core; in that the elasticity of the fabric in warp direction is at least 5% preferably 7% (measured according to ASTM D3107—Stretch, after 3 home washes) and elasticity of the fabric in weft direction is at least 15%, (ASTM D3107—stretch, after 3 home washes) and in that said fabric is bias cut.

As used herein, the term "elastic yarn" refers to a yarn comprising an elastomeric fiber, covered by a wrap or sheath, i.e. a core-spun yarn, intermingled yarn, twisted yarn, polyesters (pes), polyamides (pa), all synthetic yarns etcetera, and which provides characteristics of elasticity to the woven fabric.

Suitable fibers for the elastic filament are: polyurethanic fibers such as elasthane (e.g. Lycra, dorlastan), spandex (RadicciSpandex Co), lastol (Dow Chemical XLA).

According to a preferred embodiment, the elastomeric core comprises at least a second filament to control elongation of the first elastic filament. Suitable fibers for the second, control, filament are: polyamides such as nylon (e.g., nylon 6, nylon 6,6, nylon 6,12 and the like), polyester, polyolefins such as polypropylene and polyethylene, mixtures and copolymers of the same, PBT and bicomponent filaments namely elastomultiesters such as PBT/PET and PTT/PET filaments. Suitable staple fibers for the sheath are polyester fibers and natural fibers, preferably cotton fibers, that can be dyed. Preferred elastic yarns for the present invention are disclosed in WO2012/06248; for all these yarns, when the two filaments of the core are twisted, the twisting number is at least 200 twists per meter, preferably 300 to 600 twists/meter, to result in the two filaments elongating and retracting as a single filament.

Figure 1A:
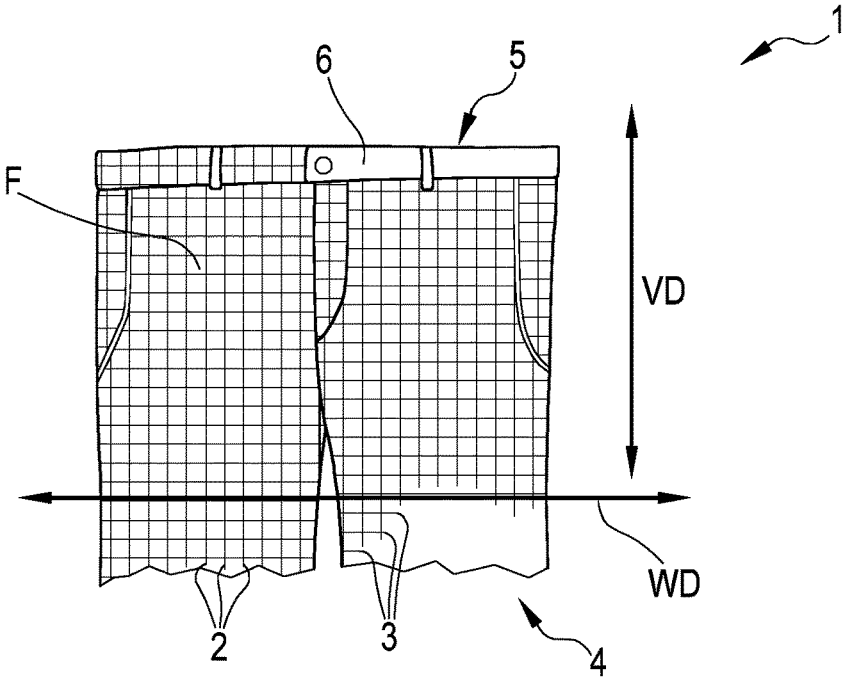
FIG. 1*a* is a schematic view of a garment using a standard cut fabric according to the prior art.

FIG. 1*a* shows a garment 1, i.e. trousers, made according to the prior art with a standard cut. The garment's fabric is shown on the garment 1 in a simplified and enlarged drawing to underline the fact that weft yarns extend widthwise (WD), i.e. horizontally, through the fabric. In the known garment, warp yarns 2 extend vertically from bottom 4 to top 5 of the garment 1.

Figure 1B:
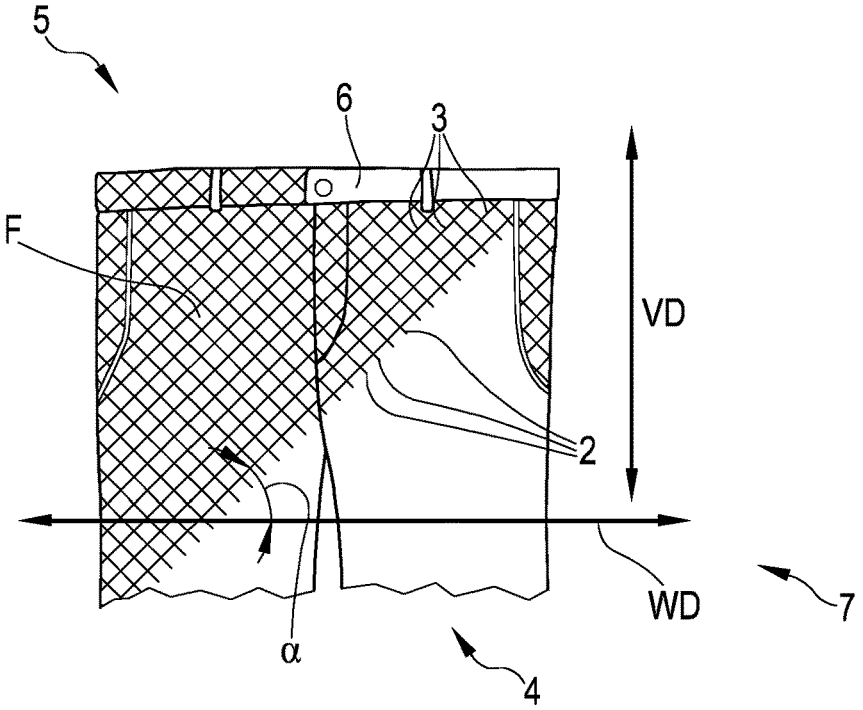
FIG. 1*b* is a schematic view of a garment using a bias cut fabric according to the prior art.

In FIG. 1*b*, the garment 7, trousers as in FIG. 1*a*, is made of a bias cut fabric where, as shown, weft yarns 3 are perpendicular to warp yarns 2. The garment 6 has a widthwise direction WD that runs from left to right of the garment substantially horizontally in the drawing; in the case of the trousers of both FIG. 1*a* and FIG. 1*b*, direction WD is shown to be parallel to the top side of the garment i.e. to waistband 6.

According to the invention, at least the weft yarns 3 in the bias cut fabric of garment 7 are elastic yarns. The elasticity of the fabric in warp direction, i.e. when stretched in direction of warp yarns 2, preferably is at least 7% and the elasticity of the fabric in weft direction, i.e. when stretched in direction of weft yarns 3, is at least 15%; in this descriptions, unless a different standard is mentioned, elasticity values are obtained by measuring elasticity according to ASTM D3107—Stretch, after 3 home washes.

As hereinafter discussed, in the preferred embodiments elasticity of the fabric in warp direction is different from elasticity of the bias cut fabric in vertical direction VD; in analogy, elasticity in weft direction is different from elasticity of the bias cut fabric in width-wise direction WD. According to preferred embodiments of the present invention, the angle $\alpha$ of the weft yarns 3 with respect to the widthwise direction WD of said garment is in the range of 10 to 80 degrees; a preferred range is 30 to 60 degrees. As shown in FIG. 1*b*, angle $\alpha$ is measured from left to right, from a weft yarn to the direction WD, that is horizontal.

Figure 2:
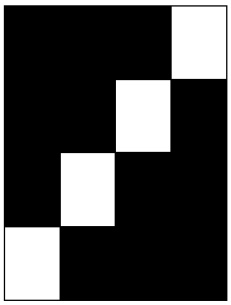
FIGS. 2 and 3 are schemes of weave constructions suitable for the present invention.
Figure 3:
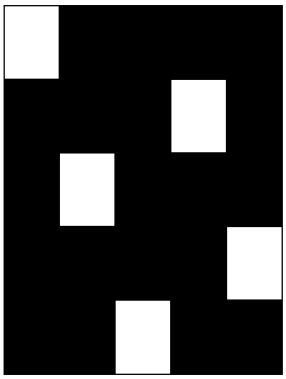

As previously mentioned, the invention may be applied to a vast number of fabrics, particularly to fabrics where warp and weft yarns cut each other at an angle of about 90 degrees. Suitable fabrics are exemplified in FIGS. 2 and 3, that show respectively, a 3/1 RHT weave and a twill weave. However, the invention is not limited to the above weaves, and can be used e.g. with a variety of different weave constructions, such as 2/1 twill weave, broken twill, zig-zag twill, reverse twill and others.

The following table 1 shows the surprising effect of elastic weft yarns, on the elasticity of a bias-cut fabric, as above discussed, with respect to a normal cut, i.e. a standard fabric. In the tested fabrics, the warp yarns are made of rigid yarns, the weft yarns are elastic, namely, all the weft yarns are elastic. The fabric in the original state has warp and weft yarns at 90 degrees; the fabric is cut to provide samples for the tests that are bias cut by 45 degrees.

In other words, the warp yarns in the bias-cut fabric are at an angle $\alpha$ of 45 degrees with respect to the line WD; in the samples used for the tests the WD is the line defining the width of the piece of fabric used for the tests.

As shown in table 1, the same fabric, when it has been bias cut, provides a dramatic increase of the values of vertical side elasticity, notwithstanding the fact that the warp yarns are not elastic.

TABLE 1

| Fabric properties | article code + cut style | vertical side elasticity VD (%) | horizontal side elasticity WD (%) |
|---|---|---|---|
| weft stretch | 45203 NORMAL cut | 7 | 48 |
| | 45203 bias cut | 44 | 44 |
| weft stretch | 45901 NORMAL cut | 6.5 | 66.6 |
| | 45901 bias cut | 48 | 49 |
| weft stretch | 98704 NORMAL cut | 7 | 18.6 |
| | 98704 bias cut | 24 | 26.6 |
| weft stretch | 44676 NORMAL cut | 7.4 | 20 |
| | 44676 bias cut | 26.66 | 30.6 |

note:
angle $\alpha$ is 45 degree in bias cut

The characteristics of the yarns used for articles 45203 45901 and 98704 are listed in the following table.

Elasticity (i.e. elongation) of the above fabrics was measured according to ASTM D3107—(stretch, after 3 home washes).

TABLE 2

| Sample | Warp Yarn | Weft Yarn | Warp Density | Weft Density | Fabric Weight |
|---|---|---|---|---|---|
| 45203 | Ne 12/1 Ring spun 100% cotton, indigo dyed yarn | 20/1 core spun peslycra | 50 ends/cm in weaving reed | 26 picks/cm finished fabric | 10-12 oz/sqyd |
| 45901 | Ne 12/1 Ring spun 100% cotton yarn | 20/1 core spun peslycra | 36 ends/cm in weaving reed | 26 picks/cm finished fabric | 10-12 oz/sqyd |
| 98704 | Ne 9/1 Ring spun 100% cotton, indigo dyed yarn | 12/1 RING SLUB core spun peslycra | 32 ends/cm in weaving reed | 22 picks/cm finished fabric | 12-13 oz/sqyd |
| 44676 | Ne 9/1 Ring spun 100% cotton, indigo dyed yarn | 12/1 core spun Lycra | 30 ends/cm in weaving reed | 19 picks/cm finished fabric | 10-12 oz/sqyd |

According to an exemplary embodiment of the invention, in addition to weft yarns 3 also warp yarns 2 are elastic yarns; elastic warp yarns may be the same as or may be different from the weft yarns. In a preferred embodiment the elasticity (i.e. elongation, measured with above mentioned method) of the warp yarns is less than the elasticity of the weft yarns. The following Table 3 shows the technical effect of a bias cut in a fabric having elastic warp and weft yarns.

TABLE 3

| | | | in normal cut | | bias cut | |
|---|---|---|---|---|---|---|
| fabric properties | article code | | horizontal weft side | vertical warp side | horizontal side WD | vertical side VD |
| warp and weft strech (both direction have elascty) | X10355 | Elasticity % | 45 | 29.6 | 69.4 | 59 |
| | X10667 | Elasticity % | 57 | 22 | 44.8 | 33.4 |
| | X10359 | Elasticity % | 36.8 | 32 | 58.2 | 53.4 |
| | X10353 | Elasticity % | 29.6 | 29.8 | 52.8 | 44.4 |
| | X10356 | Elasticity % | 40.8 | 25.6 | 63.6 | 51 |
| | X10679 | Elasticity % | 36.4 | 17.8 | 52 | 37.6 |
| | X10677 | Elasticity % | 37.2 | 24.6 | 58.8 | 44.6 |
| | X10669 | Elasticity % | 31.2 | 27.4 | 52 | 44.4 |
| | X10352 | Elasticity % | 27.4 | 29.6 | 51.6 | 43.4 |

note:
angle $\alpha$ is 45 degree in bias cut

As shown in table 3, elasticity performance is increasing after bias cut on both directions. The characteristics of the fabrics used in Table 3 are recited in the following Table 4.

TABLE 4

| Sample | Warp Yarn | Weft Yarn | Warp Density | Weft Density | Fabric Weight |
|---|---|---|---|---|---|
| X10355 | Ne 15/1 CORESPUN PESLYCRA | Ne 15/1 CORESPUN PESLYCRA | 34 ends/cm in weaving reed | 23 picks/cm finished fabric | 8-13 oz/sqyd |
| X10667 | Ne 15/1 CORESPUN PESLYCRA | Ne 15/1 CORESPUN PESLYCRA | 30 ends/cm in weaving reed | 20 picks/cm finished fabric | 8-13 oz/sqyd |
| X10359 | Ne 25/1 CORESPUN PESLYCRA | Ne 25/1 CORESPUN PESLYCRA | 54 ends/cm in weaving reed | 28 picks/cm finished fabric | 8-13 oz/sqyd |
| X10353 | Ne 20/1 CORESPUN PESLYCRA | Ne 20/1 CORESPUN PESLYCRA | 50 ends/cm in weaving reed | 28 picks/cm finished fabric | 8-13 oz/sqyd |
| X10356 | Ne 15/1 CORESPUN PESLYCRA | Ne 15/1 CORESPUN PESLYCRA | 34 ends/cm in weaving reed | 28 picks/cm finished fabric | 8-13 oz/sqyd |

TABLE 4-continued

| Sample | Warp Yarn | Weft Yarn | Warp Density | Weft Density | Fabric Weight |
|---|---|---|---|---|---|
| X10679 | Ne 15/1 CORESPUN PESLYCRA | Ne 15/1 CORESPUN PESLYCRA | 34 ends/cm in weaving reed | 23 picks/cm finished fabric | 8-13 oz/sqyd |
| X10677 | Ne 14/1 CORESPUN PESLYCRA | Ne 15/1 CORESPUN PESLYCRA | 30 ends/cm in weaving reed | 18 picks/cm finished fabric | 8-13 oz/sqyd |
| X10669 | Ne 15/1 CORESPUN PESLYCRA | Ne 15/1 CORESPUN PESLYCRA | 29 ends/cm in weaving reed | 202 picks/cm finished fabric | 8-13 oz/sqyd |
| X10352 | Ne 20/1 CORESPUN PESLYCRA | Ne 20/1 CORESPUN PESLYCRA | 50 ends/cm in weaving reed | 285 picks/cm finished fabric | 8-13 oz/sqyd |

Elasticity (i.e. elongation) was measured according to ASTM D3107—stretch, (after 3 home washes).

In a preferred embodiment, an elastic woven fabric, according to the present invention, has an elasticity in the warp direction (Ewarp) comprised in the range of 7% to over 100%, preferably 20% to 70%, more preferably 25% to 55%-60%. In an exemplary embodiment the elasticity in the weft direction (Eweft) is comprised in the range of 15% to over 100%, preferably 30% to 80%, more preferably 40% to 65%.

The improvement of the performance is obtained by the fabric of the present invention that is in fact more elastic than what people need in daily life. In this view, a normal daily use does not require the use of all elastic and elongation capacity of the fabric. Therefore the fabric of the invention will not be overstretched or stressed, thus avoiding damages and lacking of performance, such as lacking of recovery, growth increasing, and bagging. For example, in the so called "super-skinny" garments, the garment's cut is usually smaller than the normal body size. Therefore, just wearing super skinny garments, causes the stretching of the fabric which the garments are made of. In view of this fact, a normal use can cause overstretching of the fabric of the super-skinny garment, thus causing damages to the fabric and bagging, e.g. at knees and hips. The garments of the present invention avoid these problems. In particular, these problems are avoided because the fabric of the invention is able to move with human skin, i.e. is able to move as human skin does.

The elastic corespun yarn, in a preferred embodiments has an English cotton count ranging from 8 Ne to 90 Ne, preferably from 10 Ne to 80 Ne, more preferably 12Ne to 60 Ne.

The elastic woven fabric of preferred embodiments has a weight in the range of 3 oz/yard$^2$ to 20 oz/yard$^2$ after washing (washing according to ASTM D3776/96), preferably from 4 oz/yard$^2$ to 15 oz/yard$^2$, more preferably from 7 oz/y$^2$ to 14 oz/yard$^2$.

In a particularly preferred embodiment, the bi-stretch fabric of the present invention is a denim fabric.

An elastic woven fabric according to the present invention can be produced by a process characterized by weaving warp yarns and weft yarns, wherein said woven fabric is elastic in at least the weft direction and wherein said elastomeric yarns have a stretchable core and a sheath of inelastic fibers that covers said core; elasticity of the fabric in weft direction is at least 15%.

The fabric thus obtained is bias cut to provide cut fabric pieces that are eventually sewn together to make a garment.

As mentioned, in a preferred embodiment of the invention, the fabric is not heat set, i.e. it does not undergo a thermal treatment to set its elasticity to a pre-set value. It was surprisingly found that when the elastic yarns of the invention are used, in particular the elastic yarns above disclosed by reference to WO2012/062480, the resulting fabric does not have to be heat-set to avoid the occurrence of problems such as curling and torqueing. However, as discussed above, a fabric according to the invention can optionally undergo a thermal treatment.

The bias cut fabric of the invention is suitable to produce garments, i.e. clothing articles. For example, garments that can comprise the elastic woven fabric of the present invention can be leggings, pants, shorts, shirts and T-shirts, sweaters, jackets, jeans and any other garment.

The invention claimed is:

1. A garment article, comprising:

a fabric including a plurality of warp yarns and a plurality of weft yarns woven together in a pattern to provide over portions and under portions of the weft and warp yarns, the weft yarns including elastomeric yarns and said elastomeric yarns having a stretchable core and a sheath of inelastic fibers that covers said core, wherein an elasticity of the fabric in warp direction is at least 5% (measured according to ASTM D3107—Stretch, after 3 home washes) and elasticity of the fabric in weft direction is at least 15% (measured according to ASTM D3107—Stretch, after 3 home washes) and said fabric is bias cut; whereby the weft yarns in said garment article are angled with respect to a widthwise direction of said garment article, and wherein said elastomeric yarns have a stretchable core comprising a first elastic fiber and a second fiber that is less elastic than said first fiber wherein said first fiber and second fiber are connected together by intermingling, twisting or coextrusion to control elongation of said first fiber.

2. The garment article according to claim 1, wherein an angle of the weft yarns with respect to the widthwise direction of said garment article lies within a range of about 30 degrees to about 50 degrees.

3. The garment article according to claim 1, wherein the elasticity of the fabric in the weft direction lies within a range of about 25% to about 55%.

4. The garment article according to claim 1, wherein said elastomeric yarns are selected from the group including corespun yarns, intermingled polyester yarns, intermingled polyamide yarns and twisted elasthane yarns.

5. The garment article according to claim 1, wherein said fabric has a weight ranging from about 200 g/m$^2$ to about 400 g/m$^2$ (according to ASTM D3776).

6. The garment article according to claim 1, wherein said fabric has not been heat set.

7. The garment article according to claim 1, wherein said fabric is a denim fabric.

8. The garment article according to claim 1, wherein said garment article comprises one of leggings, pants, shorts, shirts, polos, T-shirts, sweaters, jackets, and jeans.

9. The garment article according to claim 3, wherein said stretchable core comprises a first elastic fiber and a second fiber that is less elastic than said first elastic fiber and wherein said first elastic fiber and said second fiber are connected together by intermingling, twisting or coextrusion to control elongation of said first elastic fiber.

10. The garment article according to claim 9, wherein said garment article comprises one of leggings, pants, shorts, shirts, polos, T-shirts, sweaters, jackets, and jeans.

11. The garment article according to claim 9, wherein said fabric is a denim fabric.

12. The garment article according to claim 1, wherein said elastomeric yarns are selected from the group including corespun yarns, intermingled polyester yarns, intermingled polyamide yarns and twisted elasthane yarns.

* * * * *